United States Patent [19]

Kurata

[11] 4,004,108

[45] Jan. 18, 1977

[54] ARMATURE FOR SOUND PICK-UP CARTRIDGE

[75] Inventor: Junichi Kurata, Tokorozawa, Japan

[73] Assignee: Pioneer Electronic Corporation, Tokyo, Japan

[22] Filed: June 11, 1975

[21] Appl. No.: 585,893

[30] Foreign Application Priority Data

June 11, 1974 Japan ..... 49-65535

[52] U.S. Cl. ..... 179/100.41 K; 179/100.41 Z

[51] Int. Cl.[2] ..... H04R 11/12

[58] Field of Search ..... 179/100.41 K, 100.41 M, 179/100.41 Z

[56] References Cited

UNITED STATES PATENTS

| | | | |
|---|---|---|---|
| 2,507,708 | 5/1950 | Greener | 179/100.41 M |
| 3,542,972 | 11/1970 | Braun | 179/100.41 K |
| 3,627,931 | 12/1971 | Matsuda | 179/100.41 K |
| 3,763,335 | 10/1973 | Marita | 179/100.41 K |

*Primary Examiner*—Raymond F. Cardillo, Jr.
*Attorney, Agent, or Firm*—Sughrue, Rothwell, Mion, Zinn & Macpeak

[57] ABSTRACT

A pick-up cartridge includes an armature being attached with a cantilever having a sound needle at an end composed of two pieces of high magnetic permeable material, each constituting a separate magnetic path, and a piece of magnetically high resistance material interposed between the two pieces of high magnetic material, a magnet provided in a relation opposing to an end of the armature, and an E-shaped yoke provided in opposition to another end of the armature with a detecting coil wound thereon, so that magnetic fluxes created by the magnet are firstly passed through one of the two pieces of the high magnetic permeable material, and on their return, passed through the other piece of the material.

3 Claims, 8 Drawing Figures

FIG. 1a
(PRIOR ART)
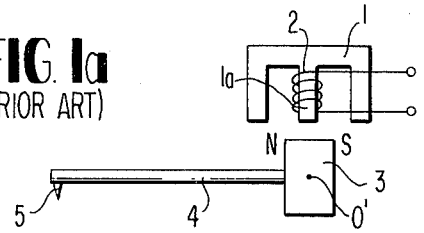
FIG. 1b
(PRIOR ART)
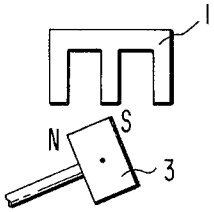
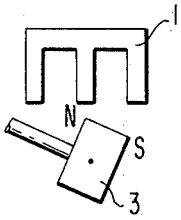
FIG. 1c
(PRIOR ART)
FIG. 2a
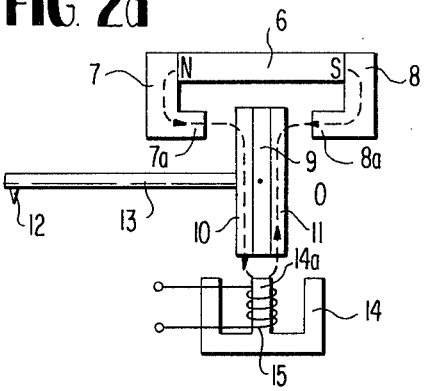
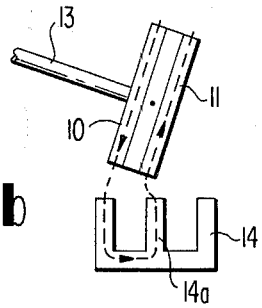
FIG. 2b
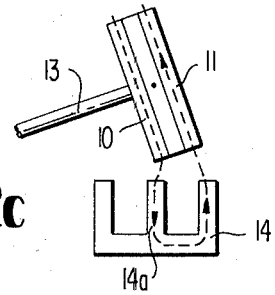
FIG. 2c
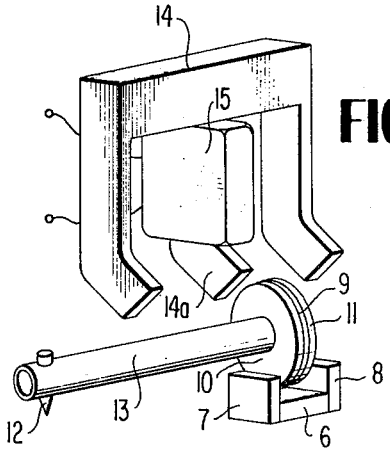
FIG. 3a
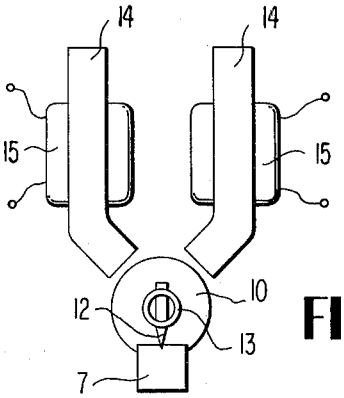
FIG. 3b

ARMATURE FOR SOUND PICK-UP CARTRIDGE

BACKGROUND OF THE INVENTION

This invention relates to an improvement of pickup cartridges used for reproducing sound in a phonographic system.

Known is a moving magnet type cartridge comprising an E-shaped yoke, a detecting coil, a magnet, a cantilever, and a sound needle, among which the detecting coil is wound around a central arm of the E-shaped yoke. When the magnet is rotated around a pivot at its center, the distribution of magnetic flux in the E-shaped yoke and therefore the value of magnetic flux in the central arm thereof is varied depending on the rotating speed. The variation of the magnetic flux in the central arm is detected by the detecting coil and converted into a signal voltage.

Although the vibration system of the moving magnet type cartridge of the above mentioned construction and operation are simple, this type of cartridge has a drawback of impairing the movability when the size of the magnet is increased for the purpose of elevating its sensitivity, and losing sensitivity when the size of the magnet is decreased for the purpose of improving the movability, because the magnet which constitutes the source of magnetic flux is rotated as an armature in the cartridge. It is of course possible to increase the number of turns of the detecting coil for elevating the sensitivity, but such a procedure deteriorates its frequency characteristics.

SUMMARY OF THE INVENTION

With the above described drawback of the conventional pickup cartridge in view, a primary object of the present invention is to provide a novel construction of the same wherein no magnet is used in the armature.

Another object of the invention is to provide a pickup cartridge whose movability and operational characteristics are better than the conventional moving magnet type cartridge, and the sensitivity thereof is much improved.

These and other objects of the invention can be achieved by a pickup cartridge of a novel construction comprising an armature being attached with a cantilever having a sound needle at an end and composed of two pieces of a high magnetic permeability material each constituting a separate magnetic path and a piece of magnetically high resistance material interposed therebetween, a manget provided in a relation opposing to an end of the armature, and an E-shaped yoke disposed in opposition to another end of the armature and having a detecting coil wound thereon, whereby magnetic flux starting from the magnet is firstly passed through one of the two pieces of the high magnetic permeability material and, on its return, passed through the other piece.

The invention will be made more apparent in the following detailed description of the invention when read in conjunction with the accompanying drawings.

BRIEF DESCRIPTION OF THE DRAWINGS

In the drawings:

FIGS. 1*a*, 1*b*, and 1*c* are diagrams showing general arrangement of a conventional moving magnet type pick-up cartridge and its operation;

FIGS. 2*a*, 2*b*, and 2*c* are diagrams showing general arrangement of a moving magnet type pick-up cartridge according to the present invention and two operational states of the same; and FIGS. 3*a* and 3*b* are a perspective view with one of the yokes being omitted and a front elevational view of a stereophonic pick-up cartridge constituting a preferred embodiment of the invention.

DETAILED DESCRIPTION

For a better understanding of the present invention, a conventional moving magnet type pick-up cartridge will first be described with reference to FIGS. 1*a*, 1*b*, and 1*c*. The pickup cartridge comprises an E-shaped yoke 1, a detecting coil 2 wound around a central arm 1a of the E-shaped yoke 1, a magnet 3 pivotable around a pivot point 0' thereof in a region adjacent to the E-shaped yoke 1, and a cantilever 4 having an end secured to the magnet 3 and another end mounting a sound needle 5. When the magnet 3 turns around the pivotal point 0', the magnetic flux created by the magnet 3 in the central arm 1*a* is varied in proportion to the rotating speed of the magnet 3 as shown in FIGS. 1(*b*) and 1(*c*). The variation of the magnetic flux is detected by the detecting coil 2 which delivers a signal voltage.

As described hereinbefore, the conventional pick-up cartridge has a drawback of impairing the movability of the magnet when the size of the latter is elevated thereby to improve sensitivity of the cartridge, and losing the sensitivity of the cartridge when the size of the magnet is reduced for improving the movability of the magnet.

A pick-up cartridge according to the present invention which can overcome the above described drawback of the conventional pick-up cartridge will now be described with reference to FIGS. 2*a*, 2*b*, and 2*c*. The moving magnet type pick-up cartridge according to this invention has a stationary magnet 6 having N and S poles, on which L-shaped yokes 7 and 8 are secured in a rigid manner. Between the ends 7*a* and 8*a* of the L-shaped yokes 7 and 8, respectively, an armature swingable around a pivot point 0 is disposed. The armature is made of two pieces 10 and 11 of a high magnetic permeability material combined in parallel with a magnetic resistance material 9 interposed therebetween, and a cantilever 13 having a sound needle 12 at an end is secured at a right angle to the armature piece 10. A stationary E-shaped yoke 14 having a central arm 14*a* is provided in such a manner that the central arm 14*a* is placed just under and facing toward the other end of the armature. On the central arm 14*a*, a detecting coil 15 is wound.

With the above described composition of the pick-up cartridge, magnetic flux delivered from N pole of the magnet 6 passes through one of the L-shaped yokes, 7, one of the two pieces, 10, of the high permeability material, E-shaped yoke 14, the other piece of high magnetic permeability material 11, the other L-shaped yoke 8, to S pole of the magnet 6. Thus, in the neutral position shown in FIG. 2*a*, no effective magnetic fluxes passes through the central arm 14*a* of the E-shaped yoke 14.

However, when the sound needle 12 traces the groove on a recording disc thereby turning the armature in the clockwise direction so that the two pieces 10 and 11 of the high permeability material are brought into a position as shown in FIG. 2*b*, upwardly directing magnetic flux passes through the central arm 14*a* of the E-shaped yoke 14. Conversely, when the armature is rotated in the counter-clockwise direction so that the two pieces 10 and 11 of the high permeable material are brought into another position shown in FIG. 2*c*, downwardly directing magnetic flux passes through the central arm 14*a* of the E-shaped yoke 14.

In other words, in accordance with the sound needle 12 tracing the groove of a recording disc, not only the amount of the magnetic flux flowing through the central arm 14*a* of the E-shaped yoke 14 is varied, but also the flowing direction of the magnetic flux is changed, and such variation and change are detected by the detecting coil 15 which produces a reproduced voltage varied in accordance with the sound groove of the recording disc. Furthermore, the invention is not necessarily limited to a pick-up cartridge for monoral use, but is also applicable to a stereophonic cartridge when another E-shaped yoke 14 is additionally provided in opposition as shown in FIGS. 3*a* and 3*b*. In either of the above described examples, the magnet 6 may be replaced by a C-shaped magnet, and by so doing, two of the L-shaped yokes 7 and 8 can be eliminated.

From the above description, it will be apparent that the present invention is advantageous over the conventional pick-up cartridge in the following points.

Firstly, since no magnet is used in the armature, the size and weight of the armature can be substantially reduced so that the movability in correct tracing of the recorded disc can be obtained. For this reason, the higher limiting frequency of the operational band is elevated with simultaneous improvement of the high-frequency operational characteristics.

Secondly, because the magnet is provided in the stationary part of the pick-up cartridge, the size and intensity of the magnet can be substantially elevated thereby to improve the sensitivity.

Thirdly, because of the high sensitivity caused by the intensified magnet, the number of turns of the detecting coil may be selected comparatively low, whereby the impedance of the pick-up cartridge can be reduced and the possibility of the frequency characteristic of the output voltage being affected by load impedance can be substantially eliminated.

While the invention has been described in detail and with reference to specific embodiments thereof, it will be apparent to one skilled in the art that various changes and modifications can be made therein without departing from the spirit and scope thereof.

What is claimed is:

1. A pick-up cartridge comprising: an armature, pivotably mounted for rotation about an axis passing therethrough, a cantilever fixedly attached to said armature and having a sound needle at an end thereof, said armature composed of two pieces of high magnetic permeability material and a piece of high magnetic resistance material interposed between said two pieces of high magnetic permeable material at right angles to the axis of rotation, each piece of high magnetic permeability material constituting a separate magnetic path, a magnet fixedly positioned in an opposing relation to an end of the armature, and an E-shaped yoke having outer arms on respective sides of a central arm and being fixedly disposed in opposition to another end of the armature, generally centered with respect thereto, and having a detecting coil wound on said central arm, whereby; magnetic flux created by the magnet is first caused to pass through one of said two pieces of the high magnetic permeability material and on its return caused to pass through the other piece of said high magnetic permeability material.

2. A pick-up cartridge as set forth in claim 1 wherein said magnet is of a bar type having two L-shaped yokes attached to the N and S poles of the bar magnet and having respective ends facing opposite sides of said interposed armature.

3. A pick-up cartridge as set forth in claim 1 wherein said magnet is of a C-shaped configuration.

* * * * *